United States Patent [19]

Conway

[11] 4,059,190

[45] Nov. 22, 1977

[54] CLIP FOR DISPENSING ADVERTISING LITERATURE

[75] Inventor: Gerald A. Conway, Cleveland Heights, Ohio

[73] Assignee: Gerald Conway & Co., Inc., Cleveland, Ohio

[21] Appl. No.: 703,469

[22] Filed: July 8, 1976

[51] Int. Cl.[2] ..... A47F 7/00

[52] U.S. Cl. ..... 211/57.1

[58] Field of Search ..... 211/54, 57, 59, 89, 211/6; 248/DIG. 3, 301, 300, 316 D, 360, 226 E, 215, 220.3, 220.4, 221.2, 221.3, 224.4, 226.5, 71, 100; 24/8, 49 CP, 150 R, 153 R, 154, 155 R, 155 BS, 155 M, 155 PC, 85 R, 3, 73 R, 73 PF, 73 GC, 73 GS, 255, 259, 85 B; 40/10, 14, 22, 23, 25

[56] References Cited

U.S. PATENT DOCUMENTS

| | | | |
|---|---|---|---|
| 556,592 | 3/1896 | Traschel et al. | 211/59 |
| 688,769 | 12/1901 | Young | 211/57 |
| 2,097,965 | 11/1937 | Caulk, Jr. | 24/153 R |
| 2,818,624 | 1/1958 | Fauteux | 248/301 X |

FOREIGN PATENT DOCUMENTS

| | | | |
|---|---|---|---|
| 11,478 | 5/1908 | United Kingdom | 24/154 |

*Primary Examiner*—Roy D. Frazier
*Assistant Examiner*—Terrell P. Lewis
*Attorney, Agent, or Firm*—Richard H. Thomas

[57] ABSTRACT

Shown is a one-piece clip of resilient plastic material for supporting and dispensing a plurality of advertisement cards. The clip is adapted for use with an upright panel, such as pegboard, provided with a clip-engageable edge, and comprises a pair of downwardly extending legs which are connected by a loop portion pressing the legs against the opposite sides of the upright panel. The rear leg is longer than the front leg having a forwardly extending protrusion spaced from the free end of the front leg adapted to pierce the panel rear side. A projection in the shape of an arrow extends from the front leg arranged to hold and dispense said cards.

5 Claims, 7 Drawing Figures

CLIP FOR DISPENSING ADVERTISING LITERATURE

The present invention relates to improvements in a card-supporting clip. The invention particularly relates to a clip which is adapted to seat over an edge of an upright panel and which is arranged to hold and dispense a plurality of advertisement cards, such as cards containing information relative to merchandise being sold.

It is an object of the present invention to provide a one-piece clip for such display cards which can be molded of a resilient plastic material and which is easy to manufacture and simple to use without installation hardware or tools.

For purposes of this application, the term "cards" shall be deemed to include tear-off sheets, brochures, pamphlets and the like containing information or advertising literature of any kind.

BACKGROUND OF THE INVENTION

Various devices are available for holding and dispensing advertisement cards advertising merchandise being sold. The problem is that most such devices are difficult to use often requiring substantial installation time and expense. For instance, it is known to affix molding to the edge of a display shelf for merchandise and to press into the molding a plurality of members capable of supporting such cards. This requires the installation time and expense of affixing the molding. Other typical support devices may even require the use of adhesive tape, wires and other unsightly devices to keep them in place. Also, not all such holding and dispensing devices are readily adaptable for use with other than standard shelf-displayed merchandise. For instance, the typical shelf-type support for holding and dispensing advertisement cards is not readily useable with floor-stacked cans and such merchandise.

SUMMARY OF THE INVENTION

The present invention in its broadest aspect relates to a one-piece, card-supporting clip of resilient plastic material adapted for use with an upright panel having a clip-engageable edge wherein the clip comprises front and rear downwardly extending legs connected by a semicircular loop portion which presses the legs against opposite sides of the upright panel. A projection on the front leg in the shape of an arrow is adapted to support a plurality of cards. The rear leg is longer than the front leg and is provided with a forwardly extending protrusion spaced from the free end of the front leg adapted to pierce the panel rear side and hold the clip securely in place.

Preferably, the upright panel is a display panel provided with a plurality of holes and/or a horizontal edge, such as provided by pegboard. The clip is snapped into place by spreading the legs apart and slipping the same over the edge of a hole or the horizontal edge until the clip loop portion seats against the edge, and then pressing the rear leg protrusion into the rear side of the panel.

In a preferred aspect of the invention, the semicircular loop portion which connects the pair of legs has a diameter approximately equal to or somewhat greater than the thickness of the panel clip-engaging edge. The front leg in the clip normal or at-rest position is biased so that it converges towards the clip rear leg contacting the same at a point removed from the loop end. Preferably, the legs are relatively straight members so that when the clip is seated on a panel edge the legs bear securely against the opposite sides of the panel. The rear leg only at its free end is provided with a curved portion which diverges into a plane approximately parallel to the normal, at-rest, plane of the front leg to facilitate installation of the clip.

DESCRIPTION OF THE DRAWINGS

The invention and objects and advantages thereof will become apparent from the following description, with reference to the accompanying drawings, in which.

Figure 6:
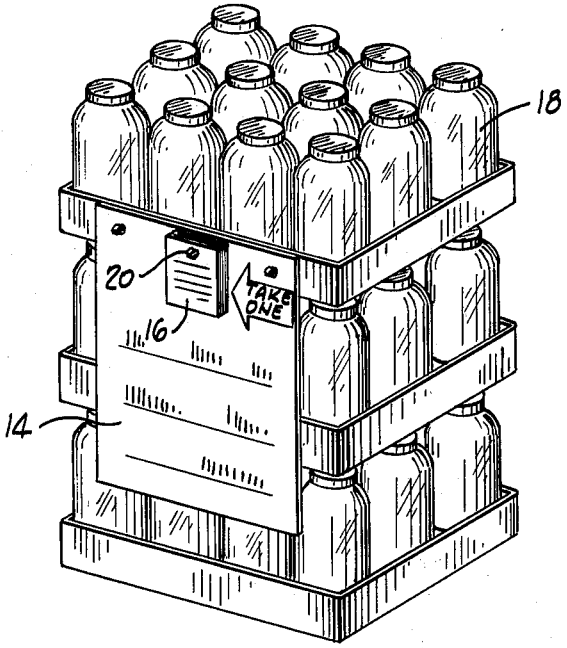
FIG. 6 is an elevation, perspective view of an upright display panel, with accompanying merchandise, bearing a card-supporting clip in accordance with the concepts of the present invention.

Referring to the drawings, and in particular FIG. 6, there is shown a typical upright display panel 14 for supporting advertising material 16 in the form of a packet of cards. The advertising material relates to merchandise 18 being sold. The supporting means for the cards 16 comprises clip 20 of the present invention.

Figure 1:
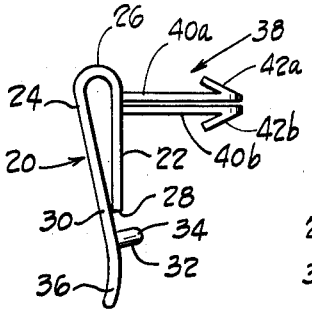
FIG. 1 is a side, elevation view of a supporting clip of the present invention.
Figure 2:
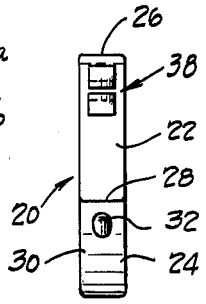
FIG. 2 is an elevation, front view of the supporting clip of FIG. 1.
Figure 3:
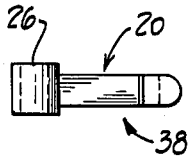
FIG. 3 is a top view of the clip of FIG. 2.

Referring to FIGS. 1–3, the clip 20 comprises front and rear legs 22 and 24 which are connected by a semicircular, U-shaped, loop portion 26. The entire clip is molded as a single piece from a resilient plastic material, so that the loop portion 26 resiliently causes the front leg 22 to converge toward the rear leg, to become at the front leg free end 28 contiguous with or preferably engaged by the rear leg at a point removed from the loop portion 26. As will be shown, the loop portion has a diameter which is approximately the same as or greater than the thickness of the display panel 14.

The rear leg 24 of the clip is longer than the front leg 22 having a lower extension 30 which extends beyond the front leg free end. At a point somewhat removed from the front leg free end, the rear leg is provided with a short protrusion or stem portion 32 which projects forwardly. The protrusion or stem portion is provided with a rounded or pointed forward end 34 which is adapted to pierce the rear side or surface of the panel engaged by the clip.

Both legs of the clip are essentially straight members as shown, the rear leg at its free end 36, however, being curved rearwardly so that it terminates in a plane which is essentially parallel with the plane of the front leg in its normal at-rest position. As will become evident, this facilitates installation of the clip.

In addition to the protrusion 32, the clip is also provided with a card-supporting element 38 affixed to the front leg. In the embodiment shown, this comprises a projection generally in the shape of an arrow, having a shank 40 comprising two slightly spaced-apart elements **40*a* and 40*b* which are parallel with each other. At the outer end of each element, a barb (42*a* and 42*b*) projects rearwardly diverging from the shank in the shape of a hook. The projection in the embodiment shown is positioned on the front leg just beneath the connection of the leg with the loop portion 26**, or at the upper end of the leg.

Figure 4:
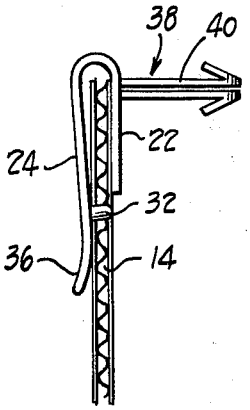
FIGS. 4 and 5 illustrate two modes of use of the clip of FIG. 1 with a display panel.

In operation, the clip may be utilized in one of two ways. It may be slipped over a top edge of the display panel 14, as shown in FIG. 4, simply by spreading the legs apart. This can be accomplished by grasping the card-supporting element shank 40 and pulling it forward with the rear leg 24 bearing against the rear side of the display panel, and then pressing downward. When the clip is firmly seated in place on the upper edge of the panel, the rear leg is pressed against the panel to press the protrusion 32 into the rear side of the panel. This firmly seats the clip in place, with the legs bearing firmly against the opposite sides of the panel.

Figure 5:
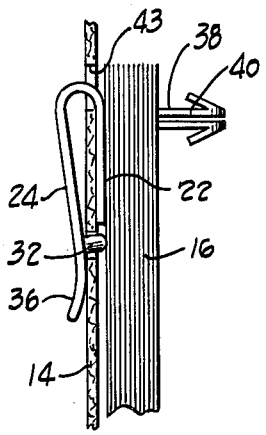

Alternatively, the clip can be positioned within a hole 43 in the panel engaging an edge of the hole, as shown in FIG. 5. This is accomplished again by grasping the clip by the card-supporting element shank 40 and slipping the rear leg curved end 36 into the hole until the protrusion 32 is through the hole, and then spreading the legs apart by pulling downwardly and forwardly on the shank 40. When the legs are sufficiently spread apart, the clip is then seated down onto the edge of the hole, and then the rear leg is pressed against the rear side of the panel to press the protrusion 32 into the rear side securely seating the clip in place.

After seating the clip in place on a display panel or like means, the packet of advertising literature cards 16, having a small diameter hole, may be placed on the card-supporting element shank 40 simply by pressing the cards so that the shank projects through the hole of the packet. In this step, the two shank elements are pressed together, and the shank barbs are also deflected to allow the card packet to slip into place. These members then resiliently spring outwardly into a normal position which prevents the cards or packet from slipping off the support.

As can be seen from FIGS. 2 and 3, the clip legs are somewhat rectangular in cross-section having relatively flat surfaces. This plus the fact that the legs are relatively straight for a substantial part of their lengths makes the clip very stable when seated in place on an edge of the display panel, as shown in FIGS. 4 and 5.

Figure 7:
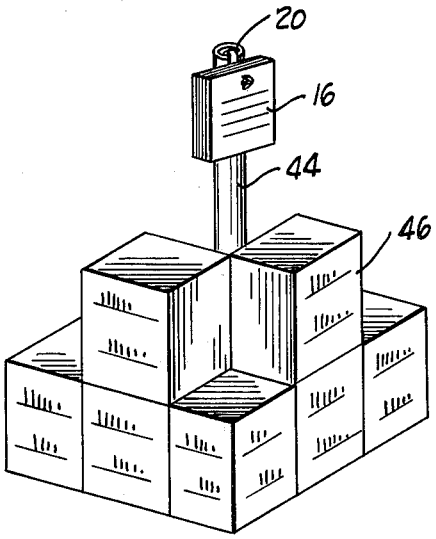
FIG. 7 illustrates an alternative mode of use of the clip of the present invention.

In the embodiment of FIG. 7, the clip is affixed to an upper edge of an upright, tubular member 44 standing adjacent merchandise 46.

It is apparent that the present invention provides a one-piece clip which is easily molded and which can readily be snapped into place on a display panel or similar support without the need of substantial installation time and tools. After installation, the clip remains securely in place despite the stress from repeated removal or dispensing of advertising literature. Preferably, the clip is made of a clear, translucent material so as not to detract from the appearance of the display panel 14.

What is claimed is:

1. A one-piece, card-supporting clip adapted for use with an upright support having a clip-engageable edge comprising front and rear downwardly extending legs;

a loop portion having a diameter approximately the same as or greater than the thickness of the support clip-engageable edge connecting said legs, the loop portion resiliently biasing the front leg so that it converges on the rear leg to become at its free end contiguous with the rear leg whereby the legs are adapted to press against opposite sides of said support adjacent the clip-engageable edge;

means projecting forwardly from the front leg to support a plurality of cards;

said rear leg being longer than the front leg and having a lower rear leg free end which curves rearwardly from the plane of the leg, the legs being essentially straight except for the rear leg curved free end, said rear leg free end terminating in approximately the same plane as the front leg; and means projecting forwardly from said rear leg spaced from the front leg free end adapted to pierce the support rear side.

2. The clip of claim 1 wherein said legs are rectangular in cross-section having flattened, opposite surfaces adapted to engage the opposite sides of the upright support.

3. The clip of claim 1 made of a resilient plastic material.

4. The clip of claim 1 wherein said forwardly projecting means on the rear leg comprises a short stem portion having a rounded or pointed forward end.

5. The clip of claim 1 wherein said card-support means comprises a member in the shape of an arrow having a shank portion and an arrowhead portion, the shank portion comprising a pair of parallel arms spaced from each other, each of said arms having a rearwardly exending barb defining the arrowhead portion, said barbs and parallel arms being compressible for the positioning of a plurality of apertured cards on said card-support means.

* * * * *